US009416598B2

(12) United States Patent
Birch

(10) Patent No.: US 9,416,598 B2
(45) Date of Patent: Aug. 16, 2016

(54) METHOD AND SYSTEM FOR PROTECTING A CONDUIT IN AN ANNULAR SPACE AROUND A WELL CASING

(75) Inventor: William Birch, Aberdeen (GB)

(73) Assignee: Shell Oil Company, Houston, TX (US)

( * ) Notice: Subject to any disclaimer, the term of this patent is extended or adjusted under 35 U.S.C. 154(b) by 324 days.

(21) Appl. No.: 14/117,799

(22) PCT Filed: May 16, 2012

(86) PCT No.: PCT/EP2012/059089

§ 371 (c)(1),
(2), (4) Date: Nov. 14, 2013

(87) PCT Pub. No.: WO2012/156434

PCT Pub. Date: Nov. 22, 2012

(65) Prior Publication Data

US 2014/0076576 A1 Mar. 20, 2014

(30) Foreign Application Priority Data

May 18, 2011 (EP) ..... 11166523

(51) Int. Cl.

| | |
|---|---|
| ***E21B 43/116*** | (2006.01) |
| ***E21B 17/10*** | (2006.01) |
| ***E21B 43/119*** | (2006.01) |
| ***E21B 43/00*** | (2006.01) |

(52) U.S. Cl.
CPC ..... *E21B 17/1078* (2013.01); *E21B 17/1035* (2013.01); *E21B 43/00* (2013.01); *E21B 43/119* (2013.01)

(58) Field of Classification Search
CPC ..... E21B 29/02; E21B 43/116; E21B 43/117; E21B 43/119
USPC ..... 166/63, 299, 297; 102/303, 305; 89/1.15
See application file for complete search history.

(56) References Cited

U.S. PATENT DOCUMENTS

| | | | | |
|---|---|---|---|---|
| 1,383,777 | A * | 7/1921 | Stephens | E21B 36/04 166/62 |
| 3,031,965 | A * | 5/1962 | Nelson | E21B 23/14 166/55.1 |
| 3,047,069 | A * | 7/1962 | Carter, Jr. | E21B 43/14 166/241.1 |
| 3,856,094 | A * | 12/1974 | Davis | E21B 43/1195 166/162 |
| 5,343,942 | A * | 9/1994 | Del Serra | E21B 17/1035 166/241.7 |
| 5,598,995 | A * | 2/1997 | Meuth | E21B 17/1035 24/273 |
| 6,268,911 | B1 | 7/2001 | Tubel et al. | |
| 6,279,392 | B1 * | 8/2001 | Shahin, Jr. | C09K 8/42 166/250.14 |
| 6,281,489 | B1 | 8/2001 | Tubel et al. | |

(Continued)

FOREIGN PATENT DOCUMENTS

| | | |
|---|---|---|
| CN | 101158271 | 4/2008 |
| CN | 101435323 | 5/2009 |

(Continued)

OTHER PUBLICATIONS

PCT International Search Report, Application No. PCT/EP2012/059089 dated Mar. 15, 2013.

*Primary Examiner* — Kenneth L Thompson

(57) ABSTRACT

To protect a hydraulic, electric and/or other conduit in an annular space around a well casing against damage from perforating and other well operations the conduit is arranged in a groove in a U- or V-shaped protective gutter, which is secured to the outer surface of the well casing and which is capable of deflecting a shaped charge.

23 Claims, 1 Drawing Sheet

(56) References Cited

U.S. PATENT DOCUMENTS

| | | | | |
|---|---|---|---|---|
| 6,557,636 | B2 * | 5/2003 | Cernocky | E21B 47/12 166/297 |
| 6,588,266 | B2 | 7/2003 | Tubel et al. | |
| 6,675,893 | B2 * | 1/2004 | Lund | E21B 33/124 166/227 |
| 6,787,758 | B2 | 9/2004 | Tubel et al. | |
| 6,962,203 | B2 * | 11/2005 | Funchess | E21B 43/08 166/263 |
| 7,040,390 | B2 | 5/2006 | Tubel et al. | |
| 7,201,221 | B2 | 4/2007 | Tubel et al. | |
| 7,284,903 | B2 | 10/2007 | Hartog | |
| 7,350,448 | B2 | 4/2008 | Bell et al. | |
| 7,461,580 | B2 * | 12/2008 | Bell | E21B 43/116 175/4.55 |
| 7,637,318 | B2 * | 12/2009 | Sierra | E21B 47/06 166/250.07 |
| 7,640,986 | B2 * | 1/2010 | Behrmann | E21B 43/117 166/297 |
| 7,668,411 | B2 | 2/2010 | Davies et al. | |
| 7,740,064 | B2 | 6/2010 | McCoy et al. | |
| 7,753,121 | B2 * | 7/2010 | Whitsitt | E21B 43/045 166/233 |
| 7,784,537 | B2 * | 8/2010 | Baxter | B21D 22/02 166/241.5 |
| 7,946,341 | B2 | 5/2011 | Hartog et al. | |
| 7,954,560 | B2 | 6/2011 | Mathiszik et al. | |
| 8,151,882 | B2 * | 4/2012 | Grigar | E21B 43/08 166/278 |
| 8,408,308 | B2 * | 4/2013 | Al Busaidy | B21C 37/0815 166/311 |
| 8,893,785 | B2 * | 11/2014 | Skinner | E21B 47/024 166/177.2 |
| 2004/0043501 | A1 | 3/2004 | Means et al. | |
| 2004/0144539 | A1 | 7/2004 | Smith et al. | |
| 2005/0109508 | A1 * | 5/2005 | Vella | E21B 43/116 166/297 |
| 2006/0196693 | A1 | 9/2006 | Bell et al. | |
| 2009/0188665 | A1 | 7/2009 | Tubel et al. | |
| 2010/0107754 | A1 | 5/2010 | Hartog et al. | |
| 2010/0207019 | A1 | 8/2010 | Hartog et al. | |
| 2010/0315630 | A1 | 12/2010 | Ramos et al. | |
| 2011/0006512 | A1 | 1/2011 | James et al. | |
| 2011/0044574 | A1 | 2/2011 | Strong | |
| 2011/0069302 | A1 | 3/2011 | Hill et al. | |
| 2011/0088462 | A1 | 4/2011 | Samson et al. | |
| 2011/0185815 | A1 | 8/2011 | McCann | |
| 2011/0216996 | A1 | 9/2011 | Rogers | |
| 2011/0280103 | A1 | 11/2011 | Bostick, III | |
| 2011/0292763 | A1 | 12/2011 | Coates | |
| 2012/0017687 | A1 | 1/2012 | Davis et al. | |
| 2012/0018149 | A1 | 1/2012 | Fidan et al. | |

FOREIGN PATENT DOCUMENTS

| | | | |
|---|---|---|---|
| DE | 2717713 | | 10/1978 |
| DE | 2717713 | A1 | 10/1978 |
| GB | 2274294 | | 7/1994 |
| GB | 2274294 | A | 7/1994 |
| WO | 2009158630 | | 12/2009 |
| WO | 2010010318 | A2 | 1/2010 |
| WO | 2010034986 | A1 | 4/2010 |
| WO | 20100136764 | A2 | 12/2010 |
| WO | 20100136810 | A2 | 12/2010 |
| WO | 2011010110 | A2 | 1/2011 |
| WO | 2011039501 | A3 | 4/2011 |
| WO | 2011058312 | A2 | 5/2011 |
| WO | 2011058313 | A2 | 5/2011 |
| WO | 2011058314 | A1 | 5/2011 |
| WO | 2011058322 | A2 | 5/2011 |
| WO | 2011067554 | A1 | 6/2011 |
| WO | 2011076850 | A1 | 6/2011 |
| WO | 2011079107 | A2 | 6/2011 |
| WO | 2011141537 | A1 | 11/2011 |
| WO | 2011148128 | A1 | 12/2011 |

* cited by examiner

METHOD AND SYSTEM FOR PROTECTING A CONDUIT IN AN ANNULAR SPACE AROUND A WELL CASING

BACKGROUND OF THE INVENTION

The invention relates to a method and system for protecting a conduit in an annular space around a well casing.

Traditionally, a well is constructed from a telescopic like series of steel tubular well casings, to provide well integrity from itself and from the surrounding rock. These well casings are cemented and/or otherwise fixed within the wellbore by some mechanical means. To allow fluids to enter or leave the wellbore it is normal to install and detonate shaped perforating charges to provide a series of penetrations through the steel conduit, cement, and into the surrounding reservoir of choice. The deployment of the perforating charges frequently requires the charges to be installed in the perforating charge carrier or gun in a spiral configuration. Shot densities of 40 shots per meter are common, and means that the entire cross section and longitudinal section of the well casing is a potential, but relatively random, target. Notwithstanding the many years and cost of researching and developing highly efficient shaped charge perforators, successful and efficient perforation is dependent on two basic factors: shot density and phasing.

In gas wells, shot density is important as it minimises turbulence as well as increasing inflow area.

Phasing increases the effective wellbore radius.

It should also not be overlooked that the single purpose of the shaped charge is to penetrate steel, cement and reservoir rock to a depth significantly beyond filter cake depth and other skin effects.

The use for data gathering, sensing, communication, and command and control of Fibre Optic or Electrical cables or small diameter Hydraulic piping (typically 7 mm or ¼" diameter stainless steel) is usually managed by mechanically clamping these on production tubulars, which are installed as a continuous production/injection fluid conduit and not considered to be part of the well construction tubulars. These cables and conduits are frequently encapsulated with a hard plastic/nylon coating to provide compression and abrasion resistance.

Production tubulars are generally installed in the well after perforating operations have been carried out and therefore any cable or hydraulic conduit clamped to them are protected from perforation damage.

There is a growing requirement for well and reservoir monitoring purposes to install cables and small diameter pipes behind the well construction casings. So doing exposes these items to potential damage or irrevocable failure caused by the unavoidable impact of perforating charges. Ultimately, it doesn't matter what the shot density or phasing is as it is not possible to guarantee the cable orientation.

Current methods to mitigate damage to cables and other conduits arranged outside a casing when a casing is perforated by explosive charges involve magnetic field disturbance detection and/or detection of sonic reflectance anomalies generated by the conduits and subsequently orienting the explosive charge such it does not hit and damage the conduit.

Examples of magnetic field disturbance detection tools are the Powered Orienting Tool (POWIT) and the Wired Perforating Platform (WPP) that are marketed by Schlumberger.

A tool for detecting sonic reflectance anomalies is the Ultra Sonic Imager Tool (USIT) marketed by Schlumberger. Incorporation of a large diameter (D=~1.25 cm) braided steel cable in the encapsulation of the conduit aids both forms of detection, while also acting as a bumper to additionally protect the conduit.

Currently available 0°—phased perforating charge guns with charges installed in a straight line can be run with the above mentioned magnetic detection tools and an electric rotating orientation tool. The USIT tool requires a separate detection/logging run before the orientation/perforating run.

Use of low-side perforating systems with preset orientation based on a USIT log to perforate horizontal wellbores has also successfully been applied.

Centralization/decentralization, depending on the detection system used, is absolutely crucial in getting reliable line detection and confidently perforating away from the cables and pipes.

Oriented perforating is significantly more expensive than normal perforating. When considering that it may take at least two separate runs, and 0° phasing means less shots per meter, the cost of oriented perforating, even when ignoring reduced production/injection capabilities, approaches three times the cost of conventional 180°/360° phased perforating. Loss of production from sub optimal phasing, added to the cost of orientation could run into millions of US dollars.

It is common to convert monitoring and/or observation wells into producers or injectors after a period of data gathering, so assuming that there is no desire to lose the data gathering and sensing capabilities in a monitoring well when converted, then the behind casing installation means commitment to oriented perforating and the consequential reduced perforating efficiency.

Thus, there is a need to protect cables and other conduits from perforating damage by deflecting the wave front or jet material generated by shaped perforating charges.

There is also a need to provide a means to perforate through a well casing or co-axial set of well casings without damaging any conduit that may be attached by clamps or other means to the outer surface of at least one of the casings.

Furthermore there is a need to remove the requirement to use oriented perforating equipment and allow the use of fully phased perforating guns.

In addition there is a need to provide a means of deploying and clamping a cable or other conduit that may be integrated with the shaped charge deflector and reeled or unreeled during installation.

SUMMARY OF THE INVENTION

In accordance with the invention there is provided a method for protecting a conduit in an annular space around a well casing, the method comprising arranging the conduit in a groove formed in a protective gutter which is secured to the outer surface of the well casing.

In accordance with the invention there is furthermore provided a system for protecting a conduit in an annular space around a well casing, the system comprising a protective gutter which is secured to the outer surface of the well casing and which comprises a groove in which the cable is arranged.

The protective gutter may have a bottom and side surfaces that are arranged in a substantially U- or V-shaped configuration, and the side surfaces may be located at a larger average distance from the outer surface of the well casing than the bottom of the gutter.

These and other features, embodiments and advantages of the method and/or system according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects.

DETAILED DESCRIPTION OF THE DEPICTED EMBODIMENTS

Figure 2:
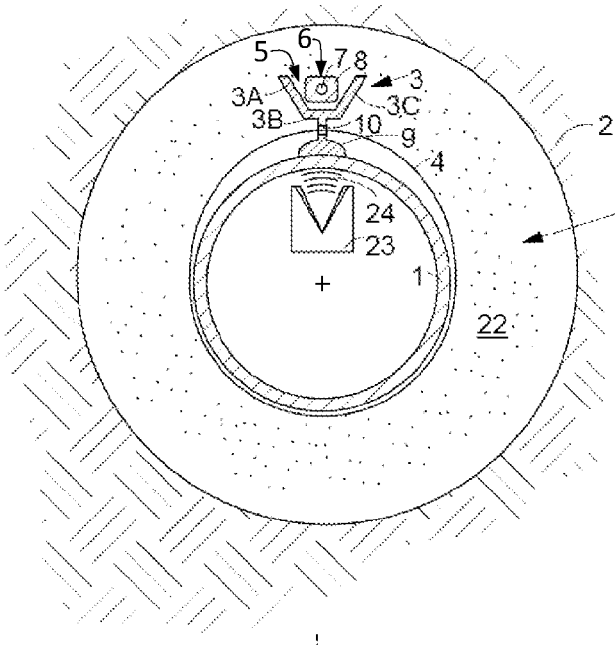
FIG. 2 is a cross-sectional view of the casing, protective gutter and conduit assembly of FIG. 1, taken along dashed line 2 in FIG. 1 and seen in the direction of arrow 2A.
Figure 1:
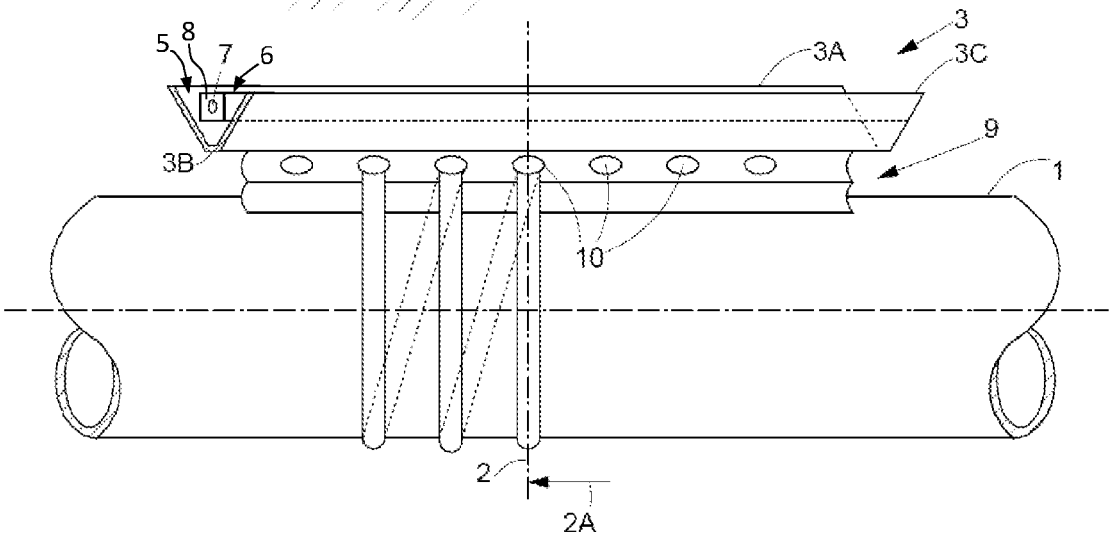
FIG. 1 is a schematic side view of a casing to which a protective gutter containing a conduit is strapped.

FIGS. 1 and 2 show a well casing 1 to which a protective gutter 3 is strapped by straps 4. The protective gutter 3 comprises a flat bottom 3A and invert triangular oriented side surfaces 3A and 3C, which form a longitudinal groove 5 that houses a conduit 6, which may comprise one or more hydraulic conduits and/or electric and/or fiber optical cables 7 that are encapsulated in an optional protective coating 8.

An invert T-shaped spacer bar 9 is secured to the flat bottom 3B of the protective gutter 3, which spacer bar 9 comprises voids 10 through which the straps 4 extend. FIG. 2 shows how the casing 1, protective gutter 3 and conduit 7 assembly is arranged in a well 20 penetrating an underground hydrocarbon fluid containing formation 21. The well casing 1 is surrounded by an annular space 22 in which the protective gutter 3 and conduit 7 are arranged and which is otherwise filled with cement or a fluid. To remove the oriented perforating inefficiencies and added cost the method and system according to the invention permit use of conventional 180°/360° phased perforating guns 23. Blast protection of the conduit 7 deployed outside of the well casing 1 therefore becomes mandatory. It is not necessary to misalign gun 23 and conduit 7 to guarantee with any certainty at all that one or more explosive charges 24 fired by the gun 23 will not coincide with the conduit 7.

To protect the conduit 7 from damage from the explosive charges 24 fired by the gun 23 the side and bottom surfaces 3A-C of the protective gutter 3 may be made of laminated metal or composite material in the general shape of an inverted triangle to be installed either separately, or as a single entity combined with the conduit 7, along the length of the casing 1 during deployment. Laminated metals and/or specifically woven composites are traditional ways of deflecting ordnance blast and these materials can survive and deflect the wave front or rapidly forming jet material generated by the explosive charges 24.

Suitable materials for this purpose are materials selected from the group of laminated steel, metallic composites and other ferrous and non ferrous materials of the group of laminated armored metallic and non metallic composites Fixing the preformed protective gutter 3, with or without attached or integral conduit 7, to the well casing 1 can be effected using reeled components and currently available cable clamps and/or straps 4. The most effective deployment method will be to form an integral, reelable system as is common practice for deploying cables and pipes on production tubulars.

The invention claimed is:

1. A method for protecting a conduit in an annular space around a well casing, the method comprising arranging the conduit in a groove formed in a protective gutter which is secured to the outer surface of the well casing, wherein the protective gutter is configured to protect the conduit against damage from explosive well perforating operations and has a bottom and side surfaces that are made of a material capable of deflecting a shaped charge.

2. The method of claim 1, wherein the bottom and side surfaces are arranged in a substantially U- or V-shaped configuration, and the side surfaces are located at a larger average distance from the outer surface of the well casing than the bottom.

3. The method of claim 2, wherein the side surfaces are arranged in an inverted triangular shape such that the side surfaces converge towards the bottom.

4. The method of claim 1, wherein the material is selected from the group of laminated steel, metallic composites and other ferrous and non ferrous materials of the group of laminated armored metallic and non metallic composites.

5. The method of claim 1, wherein the protective gutter is secured to the outer surface of the well casing by straps.

6. The method of claim 1, wherein the protective gutter extends in a substantially longitudinal direction along at least part of the length of the well casing and the conduit is a power, signal and/or fluid transmission conduit comprising at least one conduit selected from the group of electrical cables, hydraulic conduits and/or fiber optical cables.

7. A method for protecting a conduit in an annular space around a well casing, the method comprising arranging the conduit in a groove formed in a protective gutter which is secured to the outer surface of the well casing, wherein the protective gutter has a bottom and side surfaces that are arranged in a substantially U- or V-shaped configuration, and the side surfaces are located at a larger average distance from the outer surface of the well casing than the bottom, wherein the bottom of the protective gutter is mounted on an inverted T-shaped spacer bar.

8. The method of claim 7, wherein the protective gutter is secured to the outer surface of the well casing by straps.

9. The method of claim 8, wherein the T-shaped spacer bar comprises longitudinally spaced voids through which the straps extend.

10. The method of claim 7, wherein the protective gutter extends in a substantially longitudinal direction along at least part of the length of the well casing and the conduit is a power, signal and/or fluid transmission conduit comprising at least one conduit selected from the group of electrical cables, hydraulic conduits and/or fiber optical cables.

11. A method for protecting a conduit in an annular space around a well casing, the method comprising arranging the conduit in a groove formed in a protective gutter which is secured to the outer surface of the well casing, wherein the casing, protective gutter and conduit are installed and operated in accordance with the following steps:

- securing the protective gutter to the outer surface of the well casing and arranging the conduit in the gutter at the earth surface
- lowering the casing, protective gutter and conduit into a well
- perforating the well casing by explosive charges;
- completing the well; and
- inducing hydrocarbon fluid to flow through the perforations and the interior of the casing to crude oil and/or natural gas production facilities at the earth surface.

12. The method of claim 11, wherein the protective gutter has a bottom and side surfaces that are arranged in a substantially U- or V-shaped configuration, and the side surfaces are located at a larger average distance from the outer surface of the well casing than the bottom.

13. The method of claim 12, wherein the side surfaces are arranged in an inverted triangular shape such that the side surfaces converge towards the bottom.

14. The method of claim 11, wherein the protective gutter is configured to protect the conduit against damage from explosive well perforating operations and has a bottom and side surfaces that are made of a material capable of deflecting a shaped charge.

15. The method of claim 14, wherein the material is selected from the group of laminated steel, metallic composites and other ferrous and non ferrous materials of the group of laminated armored metallic and non metallic composites.

16. A system for protecting a conduit in an annular space around a well casing, the system comprising a protective gutter which is secured to the outer surface of the well casing and comprises a groove in which the conduit is arranged, wherein the protective gutter is configured to protect the conduit against damage from explosive well perforating operation and has a bottom and side surfaces that are made of a material capable of deflecting a shaped charge.

17. The system of claim 16, wherein the protective gutter has a bottom and side surfaces, which are arranged in a substantially U- or V-shaped configuration, and the side surfaces are located at a larger average distance from the outer surface of the well casing than the bottom.

18. The system of claim 17, wherein the side surfaces are arranged in an inverted triangular shape such that the side surfaces converge towards the bottom.

19. The system of claim 16, wherein the material is selected from the group of laminated steel, metallic composites and other ferrous and non ferrous materials of the group of laminated armored metallic and non metallic composites.

20. A system method for protecting a conduit in an annular space around a well casing, the system comprising a protective gutter which is secured to the outer surface of the well casing and comprises a groove in which the conduit is arranged, wherein the protective gutter has a bottom and side surfaces that are arranged in a substantially U- or V-shaped configuration, and the side surfaces are located at a larger average distance from the outer surface of the well casing than the bottom, wherein the bottom of the protective gutter is mounted on an inverted T-shaped spacer bar.

21. The system of claim 20, wherein the protective gutter is secured to the outer surface of the well casing by straps.

22. The method of claim 21, wherein the T-shaped spacer bar comprises longitudinally spaced voids through which the straps extend.

23. The method of claim 20, wherein the protective gutter extends in a substantially longitudinal direction along at least part of the length of the well casing and the conduit is a power, signal and/or fluid transmission conduit comprising at least one conduit selected from the group of electrical cables, hydraulic conduits and/or fiber optical cables.

* * * * *